US005439314A

United States Patent [19]

Wadensten

[11] Patent Number: 5,439,314

[45] Date of Patent: Aug. 8, 1995

[54] REVERSIBLE SELF-PROPELLED PLATE COMPACTOR

[76] Inventor: Theodore S. Wadensten, P.O. Box 8, Wyoming, R.I. 02898

[21] Appl. No.: 176,212

[22] Filed: Jan. 3, 1994

[51] Int. Cl.[6] ..... E01C 19/00

[52] U.S. Cl. ..... 404/133.05; 404/133.1

[58] Field of Search ..... 404/133.05, 133.1, 133.2; 74/61

[56] References Cited

U.S. PATENT DOCUMENTS

| | | | |
|---|---|---|---|
| 3,972,637 | 8/1976 | Sutherland | 404/133.1 |
| 4,113,403 | 9/1978 | Tertinek et al. | 404/133.1 X |
| 5,149,225 | 9/1992 | Artzberger | 404/133.1 |
| 5,387,052 | 2/1995 | Artzberger | 404/133.1 |

*Primary Examiner*—Michael Powell Buiz
*Attorney, Agent, or Firm*—Patrick Pinto

[57] ABSTRACT

A reversible self-propelled plate compactor which includes at least one motor driven vibrator assembly, a housing for each vibrator assembly is mounted to one end of an arm, an opposite end of the arm is attached to a tamper plate by a flex mounting members, the forces generated by the vibrator assembly are directed to the tamper plate only by way of its associated arm and the flex mounting members, the direction of the self-propelled travel being irrespective of the direction of rotation of the shaft of the vibrator assembly.

9 Claims, 3 Drawing Sheets

REVERSIBLE SELF-PROPELLED PLATE COMPACTOR

BACKGROUND OF THE INVENTION

1. Field of the Invention

With regard to the classification of the art, this invention is believed to be found in the general class entitled: "Road Structure, Process and Apparatus", and more particularly to the subclasses pertaining to "Tamper Apparatus".

2. Description of the Prior Art

Plate compactors or Tampers are known in the art. Reversible plate compactors are the subject of several known U.S. patents. These known patents are U.S. Pat. Nos. 3,001,458 issued to Croucher on Sep. 26, 1961; 3,603,224 issued to Dresher on Sep. 7, 1971; 3,832,080 issued to Stoecker on Aug. 27, 1974; 3,972,637 issued to Sutherland on Aug. 3, 1976; and 5,149,225 issued to Artzberger on Sep. 22, 1992.

U.S. Pat. Nos. 3,001,458 and 3,832,080 employ the principles of adjusting the phase angle relationship of a pair of counter-rotating eccentrics. This type of apparatus employs complex adjusting means which has a relatively short service life as a result of the stress and the environment in which operates.

U.S. Pat. No. 3,972,637 mounts the tamper plate on a vertical axis. This mounting allows the eccentric drive to be rotated about a vertical axis with respect to the compactor plate. Space considerations at the work site have made this reversing feature unusable. In many cases, the compactor must be reversed while the operator is close to a corner.

U.S. Pat. No. 3,603,224 discloses a plate compactor having a pair of eccentrics. The direction of movement is determined by the direction of rotation of the eccentrics. This arrangement requires a reversible transmission which has been found to be very expensive while lowering the service life of the compactor.

U.S. Pat. No. 5,149,225 discloses a pair of eccentrically weighted shafts fixed to a compactor plate. Each of the eccentrically weighted shafts is independently rotated by a transmission mechanism. This arrangement requires that the eccentrically weighted shafts be rotated in opposite directions for providing the desired directional movement.

All of the known reversible plate compactors include somewhat sophisticated drives. These drives add complexity to the apparatus as well as cost. The complexity of some of the arrangements require that in some cases elaborate repair parts be maintained at the work site. It has been found that an apparatus which provides reversing capability at a reasonable cost is needed. This desired plate compactor should include a simplicity of construction, operation, and maintenance.

The present invention solves the indentified limitations of the prior art. The present invention also includes a plate compactor whose reversing capabilities are irrespective of drive rotation.

SUMMARY OF THE INVENTION

The present invention may be summarized with respect to its objects. It is an object of this invention to provide and it does provide a reversible plate compactor which is simple in construction; easy to maintain and inexpensive to repair.

It is another object of this invention to provide and it does provide a plate compactor whose reversing capabilities are irrespective of the direction of rotation of the eccentric shafts. This allows the use of commercial drive without using a change of direction transmission.

All aspects of the present invention disclose a self-propelled plate compactor comprising: a tamper plate having a tamper side for contacting material to be compacted; an engine carried on a mounting plate, the mounting plate being selectively shaded; the mounting plate being resiliently attached to the tamper plate for isolating the mounting plate and the engine from the tamper plate vibrations, the engine having a drive means attached to an output shaft; a weight being eccentrically carried on a vibrator shaft for imparting vibratory motion when rotating by way of a driven means selectively driven by said drive means, the shaft having selected portions being journalled in at least one vibratory housing, this vibratory housing being attached only to one end of an arm, the opposite end of the arm having a flex mounting means for attaching to an interior side of the tamper plate, the interior side being opposite to the tamper side, an axis of the flex mounting means being transverse to a direction of self-propelled travel; and wherein the vibrator housing and said arm are selectively tilted about the axis at a predetermined angular position with respect to a plane which is parallel to the tamper side, for directing substantially all of the forces necessary for self-propelled travel into said tamper plate only by way of said flex mounting means irrespective of the direction of rotation of said vibratory shaft.

In one embodiment the flex mounting means includes a pivoting means which allows a single vibratory housing to be selectively swung from one end of the tamper plate to the other for providing reversible self-propelled travel. Isolation pads absorb tangential forces before reaching the end of the tamper plate. This first embodiment employs a intermediate transfer shaft whose axis is coincident with the pivoting axis to provide a continuity of drive from the drive means to the driven means.

Another embodiment discloses two vibratory housings which are independently driven. This second embodiment includes a common pivotal mounting for the vibratory housings as well as an intermediate transfer drive means, and a V-belt tensioning means in the form of a pair of wheels mounted on a rocker-type lever.

Still another embodiment discloses a first alternate for a flex mounting means.

Yet another embodiment of the plate compactor further includes a second vibratory housing which is rigidly mounted on the one end of the tamper plate in addition to the flex mounting of its first vibratory housing.

In the context of this invention a flex mounting means is one which allows small predetermined amounts of oscillating movement of a vibratory housing in a direction at right angles to the plane of an arm attached to the vibrator housing. This flex mounting positions the vibratory housing in spaced relationship to the tamper plate. This spaced relationship allows substantially all of the self-propelling forces to be directed to the tamper plate only through the flex mounting means.

In addition to the above summary, the following disclosure is detailed to insure adequacy and aid in the understanding of this invention. This disclosure, however, is not intended to cover each new inventive concept no matter how it may be disguised either by variations in form or additions by further improvements. For this reason, there has been chosen specific embodiments of a reversible plate compactor apparatus. The specific embodiments have been chosen for the purpose of illustration and description as shown in the accompanying drawings wherein:

Figure 2:
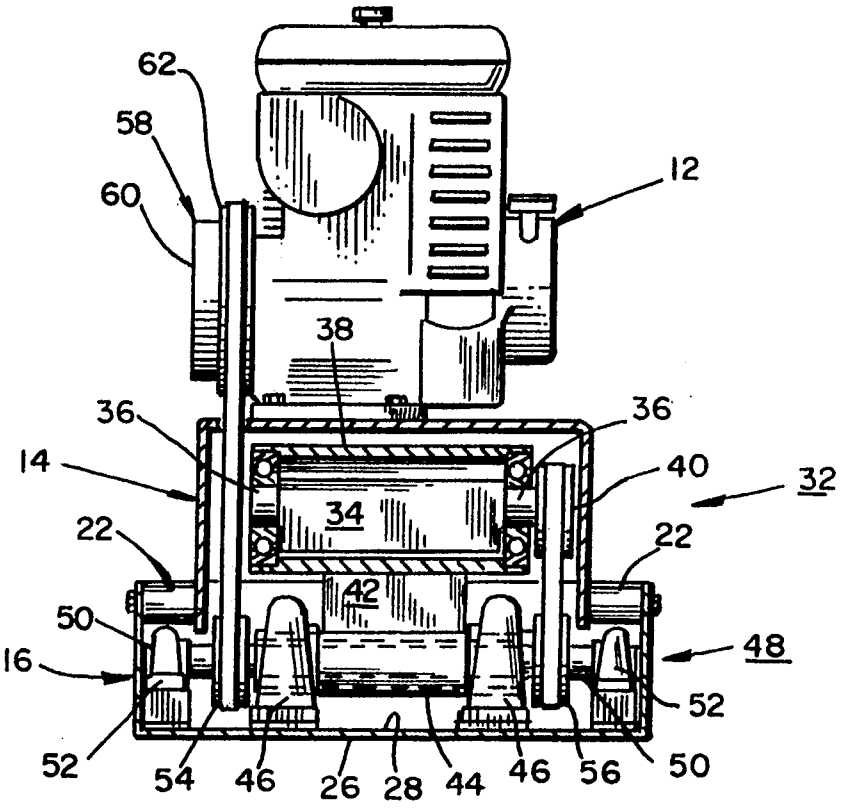
FIG. 2 represents an elevational view of one end of the apparatus, this view being partly in section to show a pivoting means arrangement.

In the following description and in the claims, various details are identified by specific names for convenience. These names are intended to be generic in their application while differentiating between the various details. Corresponding reference characters refer to like members throughout the several figures of the drawings.

The drawing accompanying, and forming a part of this specification disclose details of construction for the sole purpose of explanation. It is understood that structural details may be modified without departing from the concept and principles of the invention. This invention may be incorporated in other structural forms than shown.

DETAILED DESCRIPTION OF THE INVENTION

Figure 1:
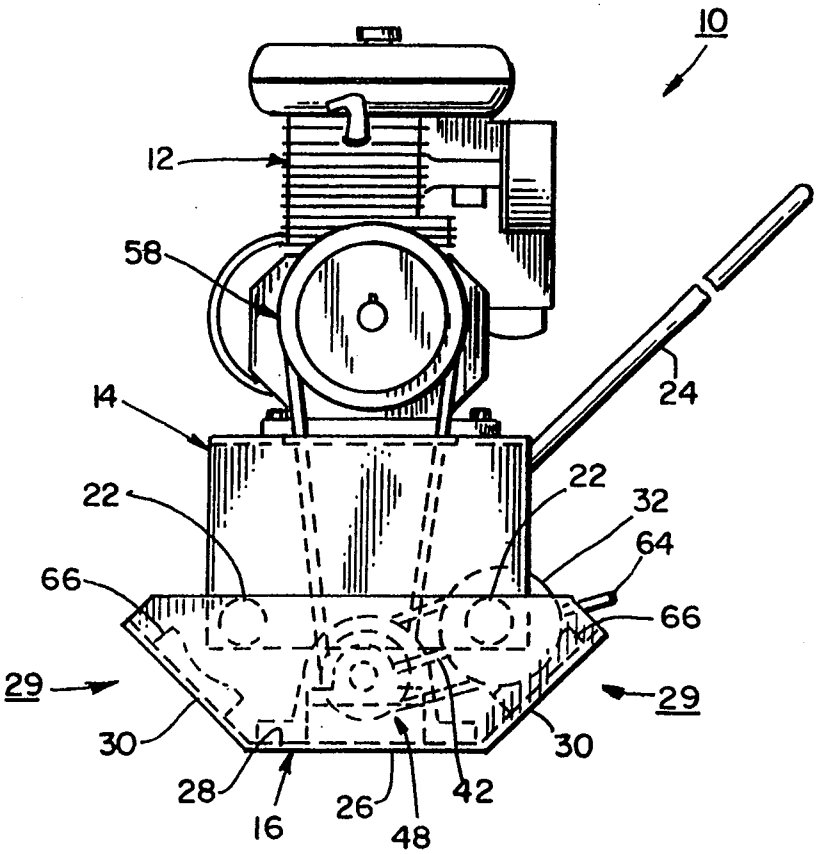
FIG. 1 represents a side elevational view of an apparatus of the present invention, This view being partly diagrammatic for ease of illustration.

Referring to FIG. 1 and FIG. 2, a first embodiment of a plate compactor is generally identified as 10, This plate compactor 10, includes a motor 12 which is removably fastened to a mounting plate 14. Preferably, this motor is an internal combustion engine. However the use of alternative motors which are electrically, pneumatically, or hydraulically powered are anticipated. The mounting plate 14 is selectively shaped and resiliently attached to a tamper plate 16 by a plurality of isolation mounts 22. A guiding handle 24 is connected to the mounting plate 14 for providing a means for manually guiding the plate compactor 10. Preferably, the guiding handle 24 is rigidly attached to the mounting plate. Alternatively, a pivoted mounting arrangement may be provided to accommodate folding of the handle for storage or transport.

It is preferred that the motor 12 be centrally mounted with respect to the tamper plate 16 in order to distribute its weight equally on the surface being compacted.

The tamper plate 16 includes a tamper side 26 and an opposite side 28. The end portions 29 of the tamper plate 16 may be formed to provide an inclined surface 30.

Referring in particular to FIG. 2, a vibrator assembly 32 includes a weight 34 which is eccentrically carried on a vibrator shaft 36. Selected portions of the vibrator shaft 36 are journaled in a vibratory housing 38. At least one end of the vibratory shaft 36 extends a selected distance beyond the housing journals for attachment of a driven means 40, such as a V-belt pulley or the like.

Referring again to FIGS. 1 and 2, the vibratory, housing 38 is attached to one end of an arm 42. The opposite or distal end of the arm 42 is attached to the opposite side 28 of the tamper plate 16 by a flex mounting means. Preferably this flex mounting means shown in this embodiment includes an elongated tube 44, as seen more clearly in FIG. 2. This elongated tube 44 is pivotally attached to the tamper plate 16 by bearing blocks 46. These bearing blocks 46 preferably are sealed pillow block bearings which are commercially available and easily serviced. The ends of the elongated tube 44 may include shouldered portions for locating the position of the tube 44 with respect to the bearing blocks 46. It is preferred that the flexing axis of the flex mounting means and the elongated tube 44 be centrally located with respect to the tamper plate 16. This flexing axis should also be transverse to the direction of self-propelled movement of the plate compactor.

Still referring to FIG. 2, an axis of an intermediate drive transfer means 48 is coincident with the flexing axis of the flex mounting means. The preferred arrangement for the intermediate drive transfer means 48 includes and elongated shaft 50 which passes interior of the elongated tube 44. Preferably, sufficient clearance is provided between the elongated shaft 50 and the inside diameter of the elongated tube 44 to allow free rotation. Alternatively, additional bearings may be provided in the ends of the tube 44 for additional support for the shaft 50. The elongated shaft 50 is rotatably mounted by at least two second pillow blocks 52. A first transfer pulley 54 and a second transfer pulley 56 are secured to the elongated shaft 50. This preferred arrangement, as shown in FIG. 2, evenly distributes the weight on the tamper plate 16. Alternatively, if weight distribution is not a consideration, the first transfer pulley 54 and second transfer pulley 56 may be secured to the shaft on the same side of the compactor. In another example, the elongated tube 44 may be replaced with a solid shaft which has shouldered end portions. The first transfer pulley and second transfer pulley may be made as a unit which is rotatably carried on the solid shaft.

The intermediate drive transfer means 48 provides a rotary V-belt drive to the driven means 40 from a drive means 58. The drive means 58 is mounted to an output shaft of the motor 12. This drive means 58 preferably includes a clutch 60 and pulley 62 arrangement for selectively engaging the drive means 58 to the motor 12.

Referring again to FIG. 1, a handle 64 preferably is attached to the vibrator housing 38. This handle 64 allows the user to pivotally swing the vibrator housing 38 between extreme end positions of the tamper plate 16. It is preferred that direct contact not be made between the vibrator housing 38 and the opposite side of the tamper plate 16. It is recommended that a pad 66 of vibration absorbing material be provided between the vibrator housing 38 and the tamper plate 16. This is to insure that substantially all forces are directed through the arm 42 and into the tamper plate 16 by way of the flex mounting means. This desired transfer of vibratory motion from the vibratory housing 38 to the flex mounting means provides the directional movement of the plate compactor irrespective of rotation of the eccentric weight 34. The direction and velocity of the compactor, for a given RPM of the motor rotation, is governed by the arcuate positioning of the vibratory housing 38. For example, when the vibratory housing is positioned as shown in FIG. 1 the movement of the plate compactor is to the right.

Figure 3:
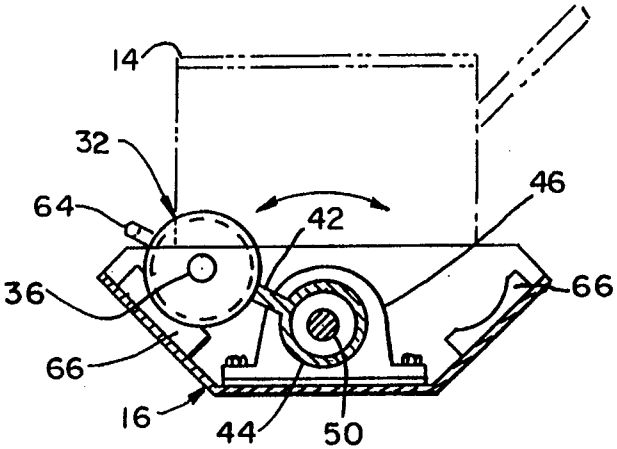
FIG. 3 represents a fragmentary side elevational view of a vibrator housing and its pivotal mounting, this view being partly schematic for ease of illustration.

Referring to FIG. 3, the vibratory housing 38 has been swung to its other extent. The direction of travel will be to the left irrespective of rotation of the eccentric weight 34. If the vibratory housing 38 was to be positioned at right angles to the plane of the tamper side 26, there would be little or no self-propelled movement in either direction.

Figure 4:
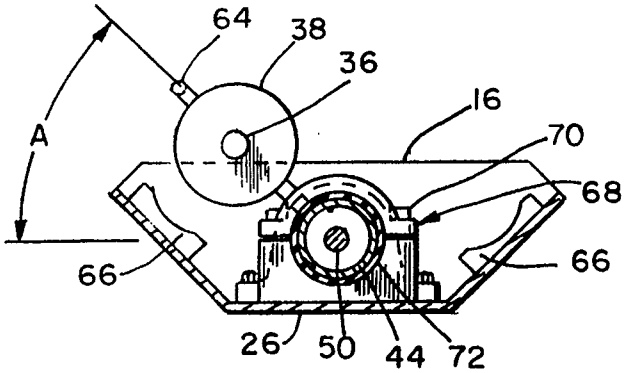
FIG. 4 represents an alternate arrangement for the pivot connection of the vibrator to a compactor plate.

Referring to FIG. 4, there is shown an alternative flex mounting means for locating the vibrator housing 38 at a selected point along its arcuate path. Selective positioning would provide the user with a means for controlling the velocity of self-propelled movement. The elongated tube 44 is held at a selected angle A by means of a clamping means 68. It is preferred that this clamping means 68 is split to allow easy arcuate movement of the vibrator housing when desired. At least two clamping screws 70 are used to clamp the tube 44. It is preferred that a bore of the clamp means 68 or the outside diameter of the tubing 44 have a layer of resilient material 72 formed thereon for allowing controlled oscillations of the vibratory housing 38 in a direction at right angles to the arm 42. This arrangement may allow for the elimination of bearing blocks 46. An operator of the plate compactor 10 may selectively position the vibrator housing 38 at any desired angle A in order to vary the self-propelled velocity of the machine. Should the operator need compaction only, the vibrator housing may be adjusted to an angle in the vicinity of 90 degrees. It has been found that an angle A in the range between 20 and 30 degrees provides satisfactory self-propelled motion as well as compaction. This flex mounting means may be used with a single vibrator as described in conjunction with FIGS. 1 and 2 or with an embodiment described below in conjunction with FIG. 5 and 6.

Figure 5:
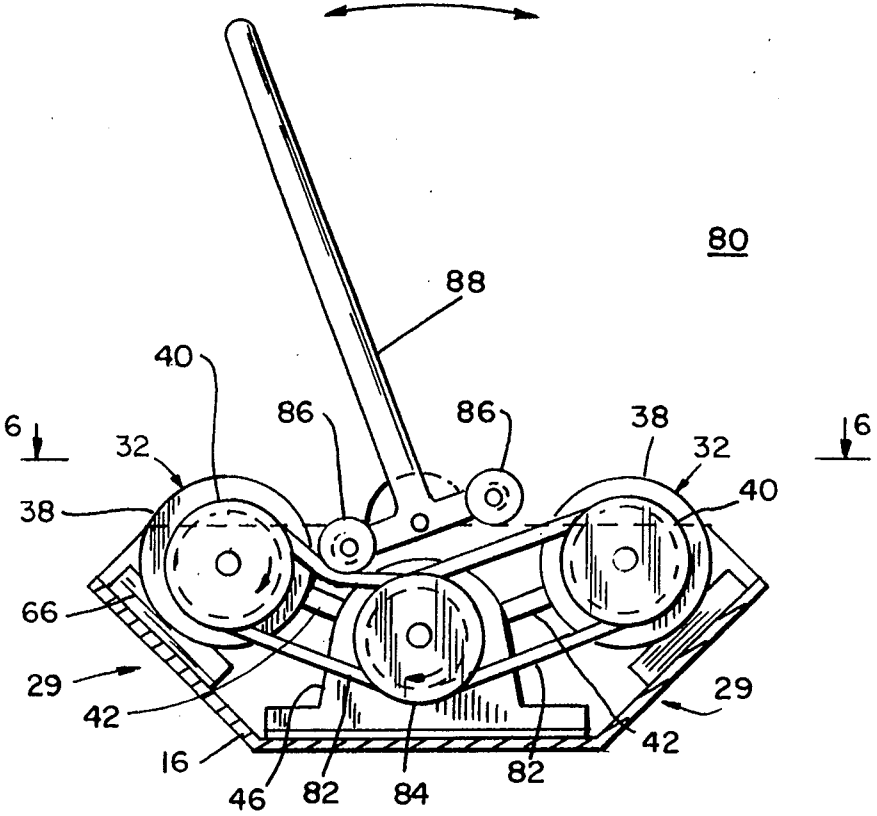
FIG. 5 represents a side elevational view, partly schematic, of a second embodiment of the present invention, this second embodiment utilizes a pair of vibrator housings pivotally mounted to the compactor plate.
Figure 6:
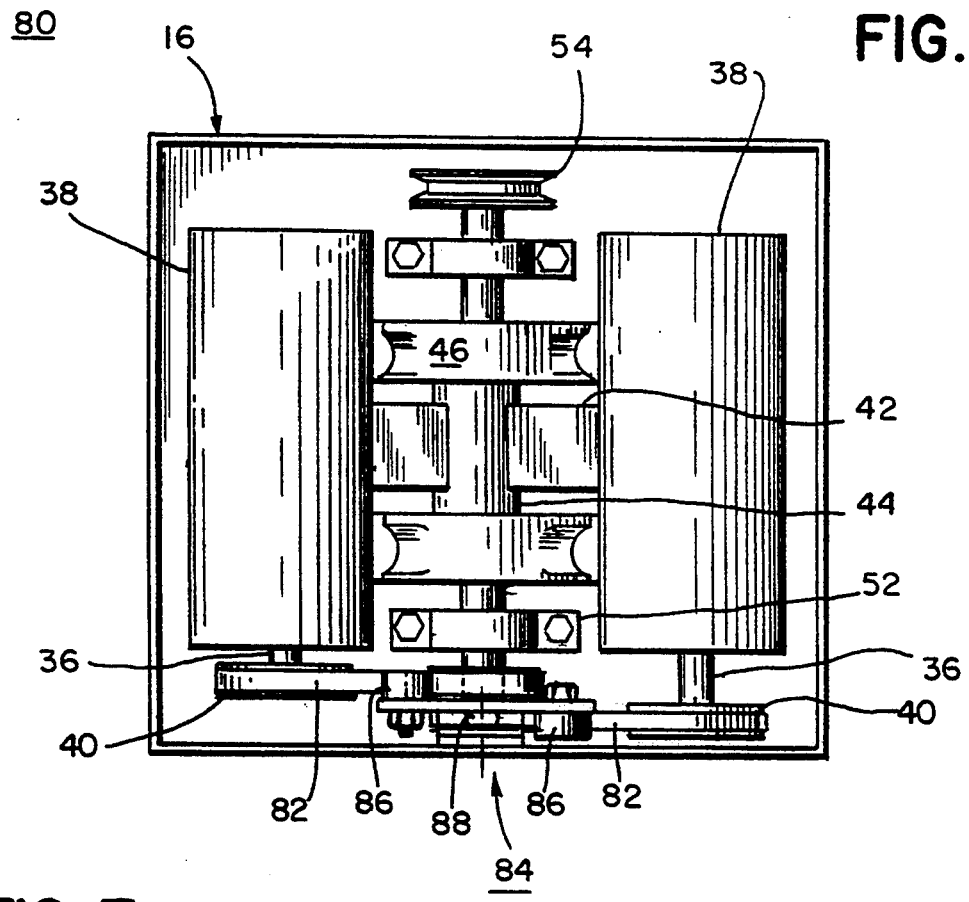
FIG. 6 represents a plan view, partly schematic, of the second embodiment of the present invention, this view being taken along line 6—6 of FIG. 5.

Referring now to FIGS. 5 and 6, an alternate embodiment of the present invention is generally identified as 80. Plate compactor 80 includes two vibrator housings 38. Each vibrator housing 38 is connected to the elongated tube 44 by its associated arm 42. Each of the vibratory housings 38 is mounted near each end 29 of the tamper plate 16. Each vibrator assembly 32 is driven by a driven means 40. This driven means 40 is preferably a V-belt pulley. Each of the driven means 40 is selectively driven by its associated V-belt 82. A second dual transfer pulley 84 includes two V-belt grooves. Each V-belt 82 is sized to allow slippage between the dual transfer pulley 84 and the V-belt 82 unless tensioned. Tension of each V-belt 82 is independently provided by a pair of tensioning wheels 86. Each of the tensioning wheels 86 is mounted on a rocker-type lever 88 which is pivotally attached to the tamper plate 16. The rocker-type lever 88 is pivotally mounted to provide tension to only one of the V-belts 82 at a time. The rocker-type lever 88 may include a spring loaded toggle arrangement for maintaining the tension on the selected V-belt. The user would move the handle about its pivot in the direction of the arrow to control the self-propelled movement of the plate compactor 80. It is preferred that a vibration isolation pad 66 be provided between each of the vibrator housings 38 and the end portions 29. It is anticipated that the isolation pads 66 may be mounted to either the vibrator housing 38 or the end portions 29. Alternatively, the flex mounting means may take the form of the type described in conjunction with FIG. 4.

As in the case of plate compactor 10, the direction of self-propelled travel is independent of the direction of rotation of the eccentric weight 34 in the vibrator housing 38. The direction of self-propelled movement of the plate compactor 80 is dependent on which end portion 29 the eccentric weight 34 is rotated.

Figure 7:
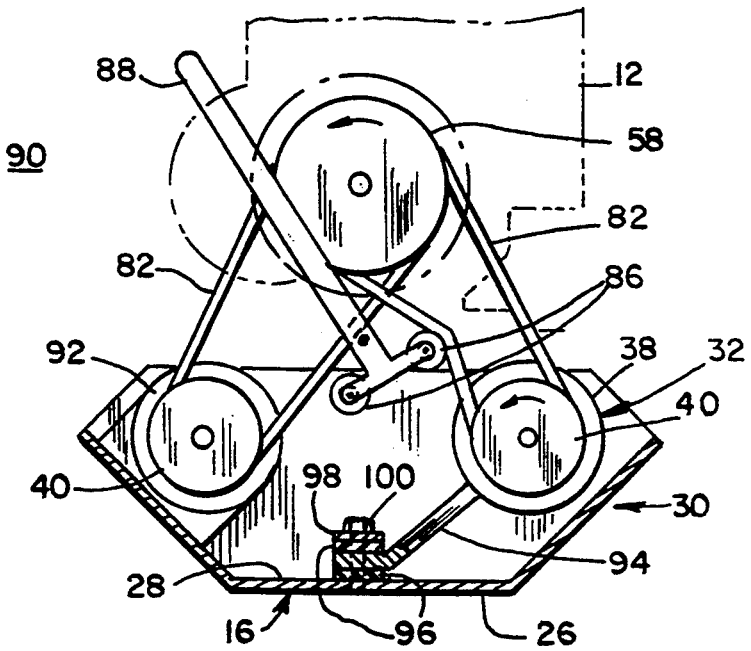
FIG. 7 represents a side elevational view of a third embodiment of the present invention, this view being shown partly diagrammatically for ease of illustration.

Referring now to FIG. 7, a third embodiment of a plate compactor is generally identified as 90. This plate compactor 90 utilizes a vibrator 92 which is attached directly to one end of the tamper plate 16. This type of mounting relies on the direction of rotation of its eccentric to produce a self-propelled direction of travel. In addition to the vibrator 92, a vibrator assembly 32 is provided for producing self-propelled travel opposite to the travel produced by vibrator 92. The vibrator housing 38 is attached to an arm 94. The arm is bent or formed to position the vibratory housing 38 at a desired angle with respect to the plane of the tamper side 26. It is important that the vibratory housing 38 be held in spaced relation with the inclined portion 30 of the tamper plate 16. The end of the arm 94 opposite the vibrator housing 38 is configured with a flex mounting means. This flex mounting means includes a bent portion of the arm which is sandwiched between two layers of an isolation material 96 such as rubber and a retaining plate 98. The flex mounting means is attached to the opposite side 28 of the tamper plate 16 by threaded fasteners 100.

A pair of V-belts 82 are rotatably driven by a drive means 58. This drive means would require a V-belt pulley having dual grooves. The V-belts 82 are sufficiently long so that neither pulley 40 is driven unless tension is applied to one or the other V-belt 82. In this example, driving tension is applied by one of the tensioning wheels 86 mounted to a rocker-type lever 88. The operation of the tensioning means has been previously described. It is anticipated that vibrator 92 may be replaced with a second vibrator housing 38 and arm 94 assembly which is attached to the tamper plate by this type of flex mounting means.

This third embodiment 90 has particular advantages. One advantage of this third embodiment, is that this configuration may be provide as a new piece of apparatus or as a retrofit to an existing uni-directional plate compactor. A second advantage is the simplicity of the design which would make an economical new apparatus or retrofit. A third advantage allows a new vibratory housing 38 to be added to an existing piece of apparatus irrespective of the direction of rotation of the motor 12.

Terms such as "left", "right", "up", "down", "bottom", "top", "front", "back", "in", "out", and the like are applicable to the embodiments shown and described in conjunction with the drawings. These terms are merely for the purpose of description and do not necessarily apply to the position in which the reversible plate compactor of the present invention may be utilized.

While a particular embodiment of a reversible plate compactor has been shown and described, it is to be understood that the invention is not limited thereto and protection is sought to the broadest extent prior art allows.

What is claimed is:

1. A reversible self-propelled plate compactor comprising:

a) a tamper plate having a tamper side for contacting material to be compacted;

b) a motor carried on a mounting plate, said mounting plate being selectively shaped; said mounting plate being resiliently attached to said tamper plate for isolating said mounting plate and said motor from said tamper plate, said motor having a drive means attached to an output shaft;

c) at least one vibratory assembly including a weight being eccentrically carried on a vibrator shaft for imparting vibratory motion when rotating by way of a driven means mounted thereon, said driven means being selectively driven by said drive means, said vibratory shaft having selected portions being journaled in a vibratory housing, said vibratory housing being attached to one end of an arm, the opposite end of the arm having a flex mounting means for attaching to an interior side of said tamper plate, said interior side being opposite to said tamper side, a flexing axis of said flex mounting means being transverse to a direction of self-propelled travel; and wherein said vibrator housing and said arm being selectively tilted about said flexing axis at a predetermined angular position with respect to a plane parallel to said tamper side for directing substantially all forces necessary for said self-propelled travel into said tamper plate by way of said arm and said flex mounting means, said direction of said self-propelled travel being irrespective of the direction of rotation of said vibratory shaft.

2. A reversible self-propelled plate compactor as recited in claim 1 wherein said flex mounting means further includes at least two isolation strips, and wherein said opposite end of the arm is sandwiched between the two isolation strips.

3. A reversible self-propelled plate compactor as recited in claim 2 wherein said opposite end of said arm includes a bent portion which is sandwiched between the two isolation strips, said bent portion being configured for maintaining a spaced relationship between said vibratory housing and a proximal point of said tamper plate.

4. A reversible self-propelled plate compactor as recited in claim 2 wherein said driven means being selectively driven by a drive means includes a rocker type tensioning means for selectively applying a driving tension to a belt drive from said drive means to only one driven means.

5. A reversible self-propelled plate compactor as recited in claim 1 wherein said flex mounting means further includes:

a) a pivoting means having its axis coincident with said flexing axis, said pivoting means being configured for selectively positioning said vibrator housing along an arcuate path, said arcuate path having said flexing axis as its center, said positioning of said vibratory housing along said arcuate path determining the direction and velocity of said self-propelled travel, and b) an intermediate drive transfer means having its axis coincident with said pivoting axis, said intermediate drive transfer means for providing a rotary drive from said drive means to said driven means at any point along the arcuate path.

6. A reversible self-propelled plate compactor as recited in claim 5 wherein said pivoting means further includes a clamping means for maintaining said vibrator housing at a selected point along said arcuate path.

7. A reversible self-propelled plate compactor as recited in claim 5 wherein said flex mounting means further includes at least one isolation pad for maintaining a spaced relationship between said vibratory housing and said tamper plate at terminating points along said arcuate path.

8. A reversible self-propelled plate compactor as recited in claim 5 which further includes two vibratory assemblies, each vibratory assembly being positioned at opposite ends of said tamper plate, an isolation pad associated with each vibratory assembly for maintaining a spaced relationship between said vibratory housing and its associated end of the tamper plate, each vibratory assembly having a belt drive from said intermediate drive transfer means to its driven means, and a tensioning means for selectively applying tension to only one of said belt drives from said intermediate drive transfer means to said driven means at a time.

9. A reversible self-propelled plate compactor as recited in claim 6 which includes two vibratory assemblies, each vibratory assembly being positioned at opposite ends of the tamper plate, each vibratory assembly having a belt drive from said intermediate drive transfer means to its driven means, and a tensioning means for selectively applying a drive tension to only one of said belt drives from said intermediate drive transfer means to said driven means at a time.

* * * * *